US010018312B2

(12) United States Patent
Katterheinrich et al.

(10) Patent No.: US 10,018,312 B2
(45) Date of Patent: Jul. 10, 2018

(54) LIGHT FIXTURE WITH TOUCH CONTROL FINIAL

(71) Applicant: TARGET BRANDS, INC., Minneapolis, MN (US)

(72) Inventors: Kent D. Katterheinrich, Shoreview, MN (US); Elizabeth Kern, Minneapolis, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 311 days.

(21) Appl. No.: 15/144,315

(22) Filed: May 2, 2016

(65) Prior Publication Data

US 2017/0314748 A1 Nov. 2, 2017

(51) Int. Cl.
*F21S 6/00* (2006.01)
*F21V 23/04* (2006.01)
(Continued)

(52) U.S. Cl.
CPC ..... *F21S 6/002* (2013.01); *F21S 6/005* (2013.01); *F21V 1/143* (2013.01); *F21V 3/02* (2013.01);
(Continued)

(58) Field of Classification Search
CPC ..... F21S 6/002; F21S 6/005; F21V 1/143; F21V 3/02; F21V 3/0615; F21V 3/0625;
(Continued)

(56) References Cited

U.S. PATENT DOCUMENTS 2,694,137 A 11/1954 Williams
D306,768 S 3/1990 Yuen
(Continued)

FOREIGN PATENT DOCUMENTS

WO WO 2009115095 A1 * 9/2009 ..... F21V 21/0808
WO WO 2013044609 A1 * 4/2013 ..... F21S 6/00

OTHER PUBLICATIONS

"Special Art Lighting Living Room Hotel Project Corridor Hallway Bedroom Clubs Acrylic Floor Lamp", printed from www.aliexpress.com/item/Special-art-lighting-living-room-hotel . . .ct-corridor-hallway-bedroom-clubs-acrylic-floor-lamp/32338002086.html, publicly available at least as early as Aug. 5, 2015 (3 pages).
(Continued)

*Primary Examiner* — Mary Ellen Bowman
(74) *Attorney, Agent, or Firm* — JoAnn M. Seaton; Griffiths & Seaton PLLC

(57) ABSTRACT

A light fixture includes a platform, a trunk support, a light source assembly, and a finial. The trunk support is coupled to and extends upwardly from the platform. The trunk support defines an elongated cavity therein, exterior surfaces facing away from the elongated cavity, and an end opposite the platform. The end defines an opening to the elongated cavity. The light source assembly includes light sources and wiring in electrical communication with the light sources. The light sources are coupled to exterior surfaces of the trunk support, and the wiring extends from the light sources, into the elongated cavity, and out the opening in the end of the trunk support. The finial caps the top end of the trunk support. The finial is coupled with the wiring extending out the opening in the end of trunk support to maintain electrical continuity with the light source assembly.

20 Claims, 7 Drawing Sheets

(51) Int. Cl.

| | |
|---|---|
| ***F21V 23/00*** | (2015.01) |
| ***F21V 3/02*** | (2006.01) |
| ***F21V 1/14*** | (2006.01) |
| ***F21V 19/00*** | (2006.01) |
| ***F21V 17/06*** | (2006.01) |
| *F21Y 103/00* | (2016.01) |

(52) U.S. Cl.
CPC ..... *F21V 17/06* (2013.01); *F21V 19/003* (2013.01); *F21V 23/002* (2013.01); *F21V 23/0485* (2013.01); *F21Y 2103/003* (2013.01)

(58) Field of Classification Search
CPC ..... F21V 17/06; F21V 19/003; F21V 23/002; F21V 23/0485; F21V 17/12; F21Y 2103/003
See application file for complete search history.

(56) References Cited

U.S. PATENT DOCUMENTS

| | | | | |
|---|---|---|---|---|
| 5,890,794 | A * | 4/1999 | Abtahi | B60Q 7/00 362/294 |
| D606,673 | S | 12/2009 | Kao | |
| 7,661,839 | B2 | 2/2010 | Tsai | |
| D622,886 | S | 8/2010 | Zheng et al. | |
| 7,815,333 | B2 * | 10/2010 | Liu | F21S 9/037 362/145 |
| 7,946,741 | B2 * | 5/2011 | Nichols | B63B 45/04 362/431 |
| 8,177,388 | B2 | 5/2012 | Yen | |
| D662,629 | S | 6/2012 | Tung et al. | |
| D674,930 | S * | 1/2013 | Zhang | D26/3 |
| D698,054 | S | 1/2014 | He et al. | |
| 8,678,611 | B2 | 3/2014 | Chu et al. | |
| D701,986 | S | 4/2014 | Goeckel | |
| D711,573 | S | 8/2014 | Payne | |
| D715,974 | S | 10/2014 | Tunze et al. | |
| D717,477 | S | 11/2014 | Nakamura et al. | |
| 8,876,324 | B2 | 11/2014 | Seehof | |
| 8,974,078 | B2 | 3/2015 | Lin | |
| 9,033,541 | B2 | 5/2015 | Porter | |
| D732,718 | S | 6/2015 | Amrine, Jr. | |
| 2006/0152916 | A1 * | 7/2006 | Lee | A45B 3/04 362/102 |
| 2009/0040749 | A1 * | 2/2009 | Burgei, Jr. | F21S 8/028 362/183 |
| 2013/0058074 | A1 | 3/2013 | Somei et al. | |
| 2013/0265747 | A1 * | 10/2013 | Liu | F21L 4/005 362/157 |
| 2014/0049972 | A1 * | 2/2014 | McGuire | F21V 21/00 362/427 |
| 2015/0029742 | A1 * | 1/2015 | Chen | F21K 9/52 362/555 |
| 2015/0292696 | A1 * | 10/2015 | Soofer | F21S 9/035 362/554 |

OTHER PUBLICATIONS

"My New Flame LED Table Lamp", printed from http://store.luminaire.com/lighting/my-new-flame, publicly available at least as early as Jan. 14, 2015, per http://web.archive.org (1 page).

"Modern Floor Lamp with White Shades in Teak Finish", printed from www.destinationlighting.com/item/modern-floor-lamp-white-shades-teak-finish/P666196?q=P666196&newSearch=n, publicly available at least as early as Aug. 19, 2015 (1 page).

"Adesso Home Lighting Angelina Natural Accent Lamp", printed from www.destinationlighting.com/item/adesso-home-lighting-angelina-natural-accent-lamp/P854406?q=P854406 &newSearch=n, publicly available at least as early as Aug. 19, 2015 (1 page).

* cited by examiner

LIGHT FIXTURE WITH TOUCH CONTROL FINIAL

CROSS-REFERENCE TO RELATED APPLICATION

This application is related to U.S. Patent Application No. 29/563,107, filed on May 2, 2016.

BACKGROUND OF THE INVENTION

Driven largely by environmental and efficiency concerns, light emitting diodes (LEDs) have become popular replacements for fluorescent, incandescent, and other light-generating devices. LEDs are characterized by a longer life span and higher energy efficiency than conventional light-generating devices but also emit light at greater spot intensities and produce higher levels of heat than conventional light-generating devices. In addition, since LEDs are generally smaller and do not make use of a typical light electrical socket, existing light fixture housings for receiving fluorescent or incandescent light-generating devices, the associated shades, and/or other accessories do not provide proper structure or electrical support to fully make use of LEDs or similar light-generating devices.

SUMMARY

One embodiment of the invention relates to a light fixture including a platform, a trunk support, a light source assembly, and a finial. The trunk support is coupled to and extends upwardly from the platform. The trunk support defines an elongated cavity therein, exterior surfaces facing away from the elongated cavity, and an end opposite the platform. The end defines an opening to the elongated cavity. The light source assembly includes light sources and wiring in electrical communication with the light sources. The light sources are coupled to one or more of the exterior surfaces of the trunk support, and the wiring extends from the light sources, into the elongated cavity, and out the opening in the end of the trunk support. The finial caps the top end of the trunk support and is at least partially formed of a conductive material. The finial is coupled with the wiring extending out the opening in the end of trunk support to maintain electrical continuity with the light source assembly and allowing the finial to function as a touch control for the light source assembly. Other light fixtures, lamps, assemblies, and methods are also described herein.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the term "about" or "substantially" apply to all numeric values or descriptive terms, respectively, and generally indicate a range of numbers or characteristics that one of skill in the art would consider equivalent to the recited values or terms, that is, having the same function or results.

One embodiment of the innovation provides a light fixture having increased efficiencies associated with use of light emitting diodes (LEDs) while providing a diffused light such that the point source nature of the emitted light is largely disguised. In one example, light fixture provides for a simplified structure using a single linear trunk support to both support the light sources and also to support shade. In one example, light fixture is formed in a manner maintaining electrical continuity with a finial such that the finial serves not only as a visual topper, but also serves as a touch control for at least partially controlling light emitted by the light fixture.

Figure 1:
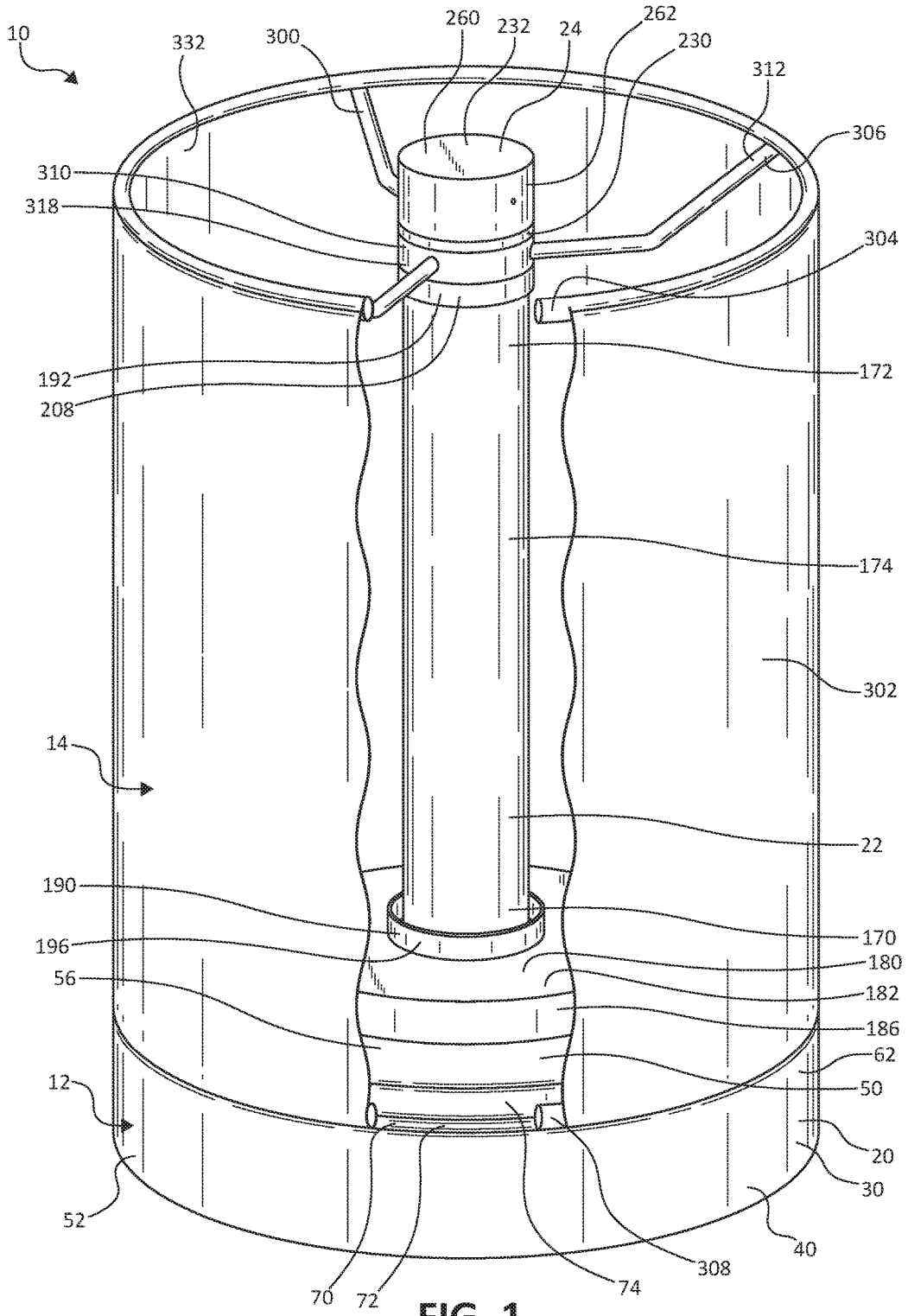
FIG. 1 is a front perspective view illustration of a light fixture, according to one embodiment of the present invention.

Turning to the figures, FIG. 1 illustrates a front perspective view illustration of a light fixture 10, according to one embodiment of the present invention. Light fixture 10 includes a lamp 12 emitting light and a shade 14 diffusing light from lamp 12 and/or providing aesthetic appeal to light fixture 10. In one embodiment, lamp 12 includes a base fixture 20 providing the overall structure and light to lamp 12, a diffusing tube 22 lessening any point light effect from base fixture 20, and a finial 24 configured to facilitate coupling diffusing tube 22 to base fixture 20 and, in one example, for providing touch control to light fixture 10.

Figure 2:
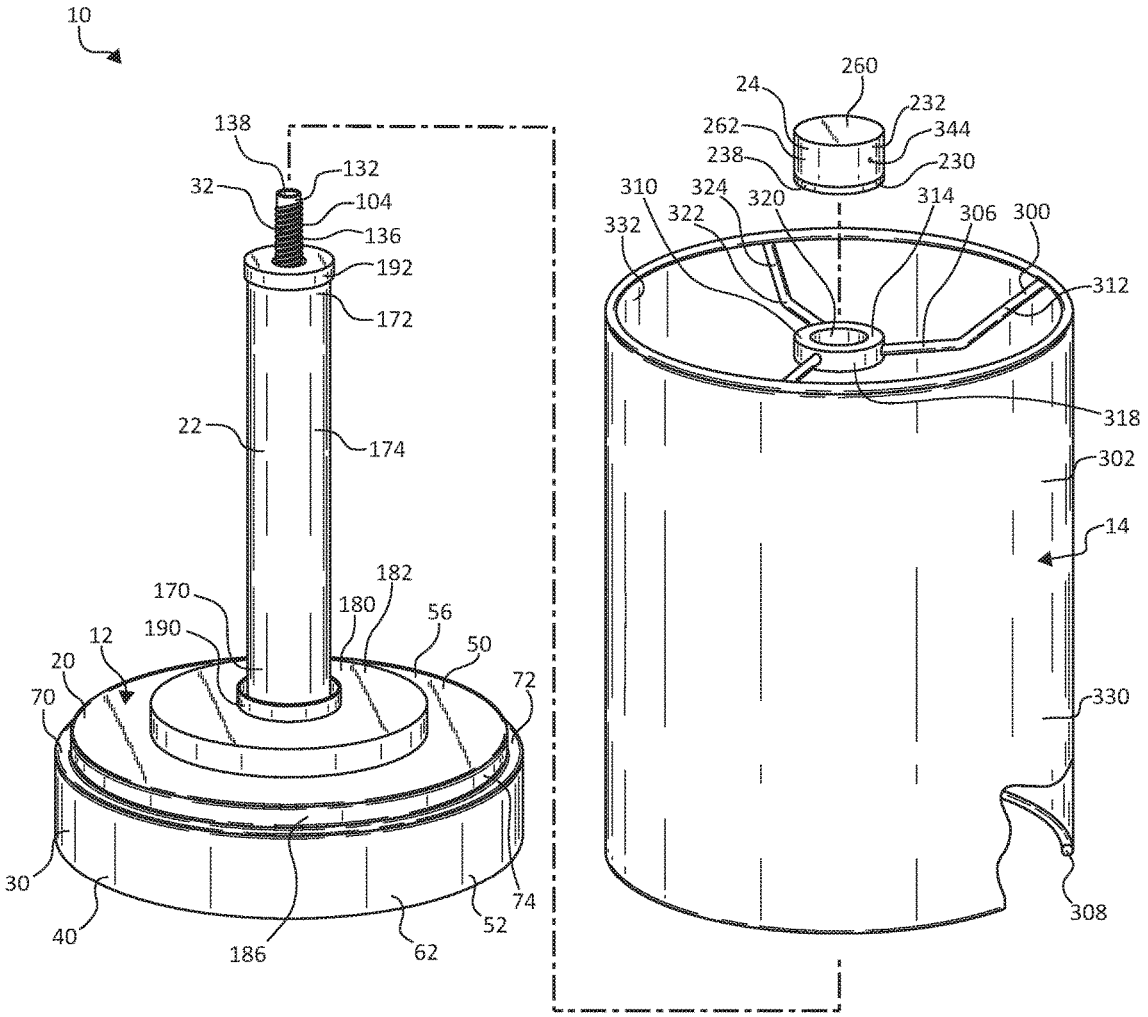
FIG. 2 is a partially exploded, front perspective view illustration of the light fixture of FIG. 1, according to one embodiment of the present invention.
Figure 3:
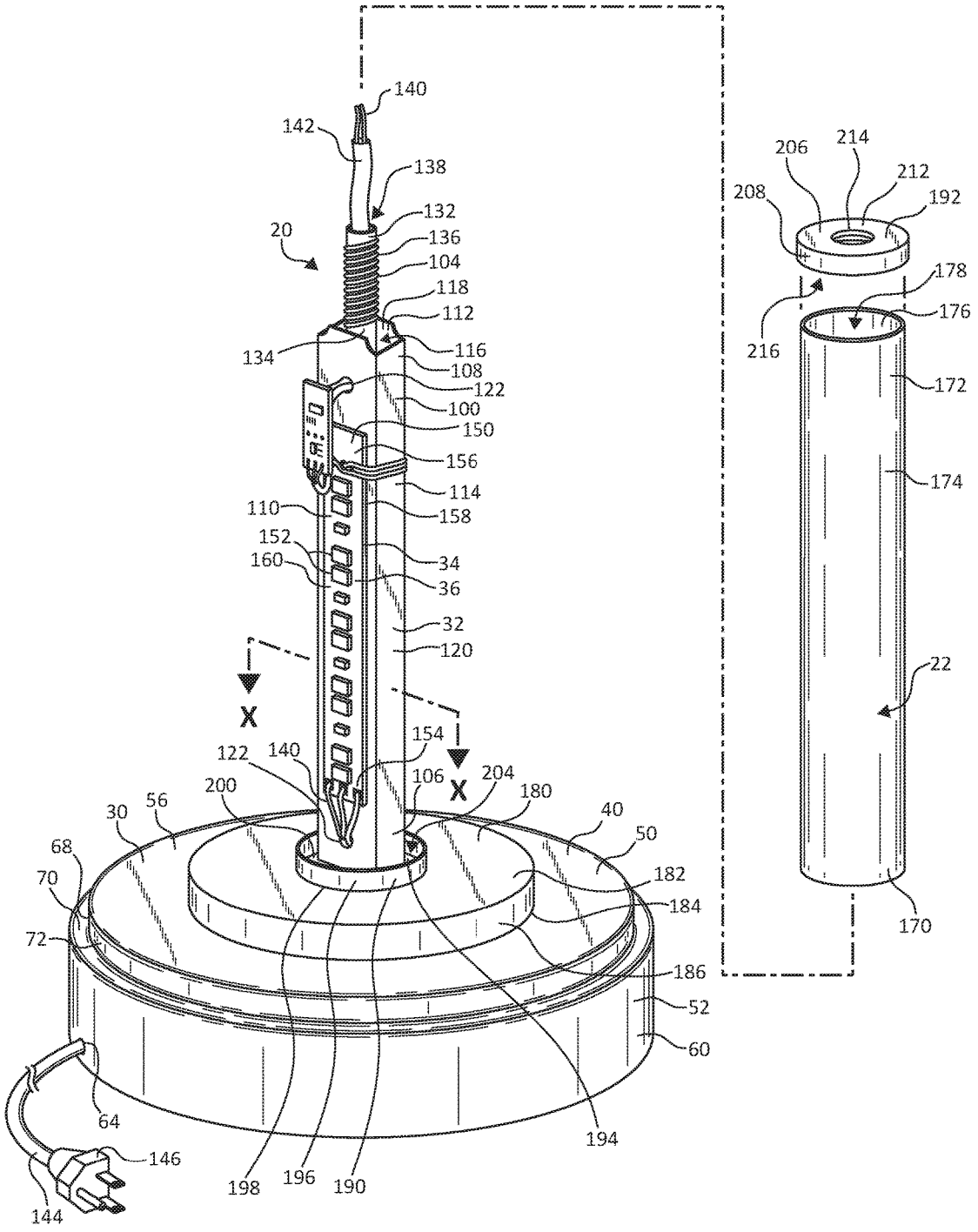
FIG. 3 is an exploded, front perspective view illustration of a lamp of the light fixture of FIG. 1, according to one embodiment of the present invention.

Referring to the partially exploded view of light fixture 10 in FIG. 2 and the exploded view of the lamp 12 in FIG. 3, base fixture 20, in one example, includes a platform 30, a trunk support 32, and a light source assembly 34. Platform 30 is configured to fit on a support surface (not shown), such as a table or floor, that is external to light fixture 10 in a manner providing stability to base fixture 20. Trunk support 32 extends upwardly, away from a center of platform 30 to provide a substantially vertical and substantially linear support for light source assembly 34. Light source assembly 34 may take on any of a variety of forms, and in one embodiment, is in the form of a plurality of light strips 37 coupled to each other and extending along trunk support. Finial 24 tops trunk support 32 maintaining base fixture 20 in an assembled state and, in one example, provides for touch control of light fixture 10.

Figure 4:
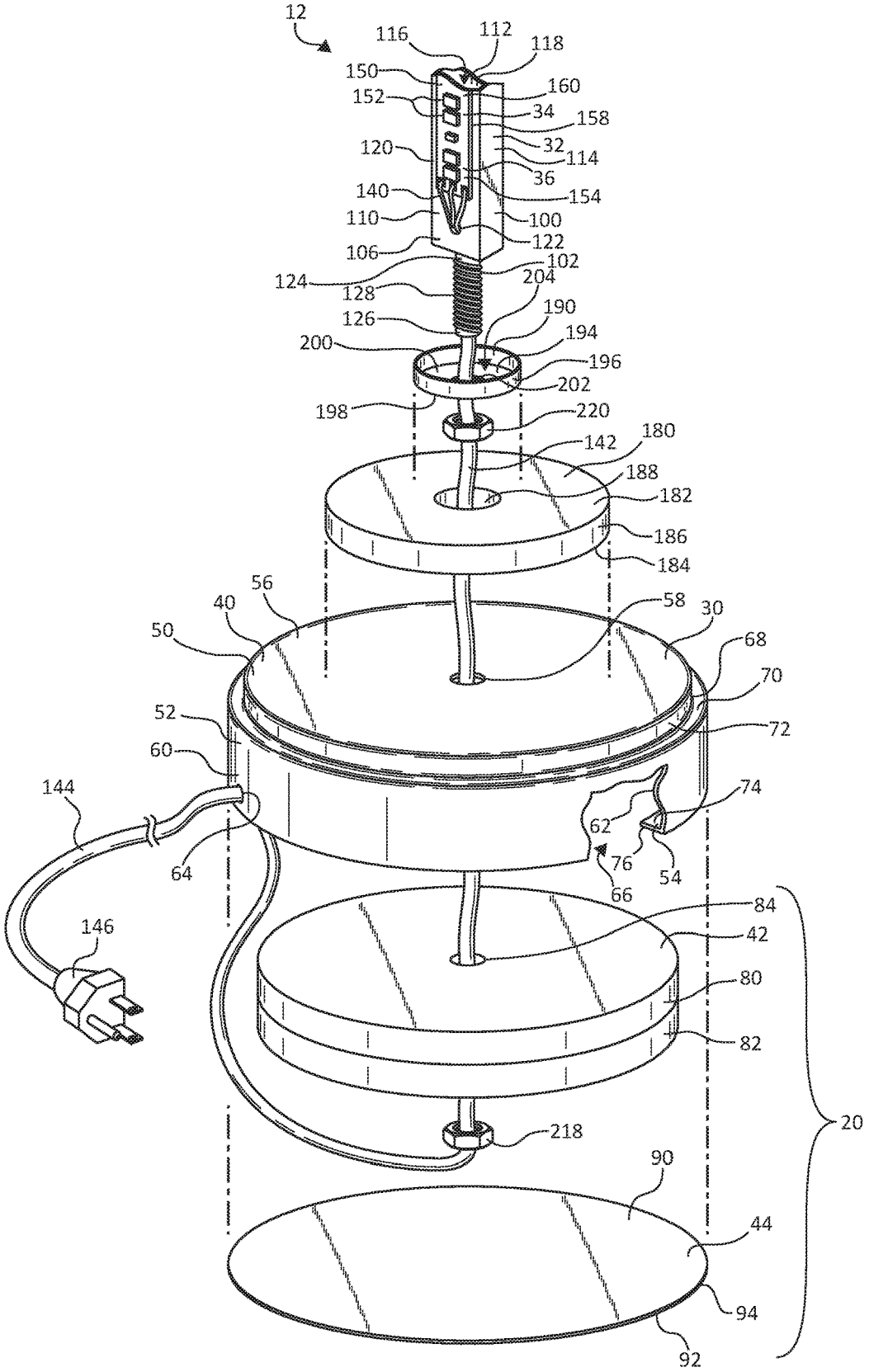
FIG. 4 is a bottom portion detail view of an exploded, front perspective view illustration of the lamp of FIG. 3, according to one embodiment of the present invention.

More specifically, as shown with additional reference to the further exploded view of FIG. 4, platform 30 includes a housing 40, a weight 42, and a bottom cover 44. Housing 40 provides the outer shell and overall shape of platform 30 and is formed of any suitable material such as metal, plastic, alloy, polycarbonate, or other material configured to maintain structural integrity of platform 30 and provide the needed base function to light fixture 10 (FIG. 1). In one example, housing 40 includes a top wall 50, a sidewall 52 depending downwardly from top wall 50, and a bottom wall 54 opposite top wall 50. Top wall 50, more specifically, includes a top surface 56 and an opposite, bottom surface (not shown). Top surface 56 is substantially planar, in one embodiment, and includes an aperture 58 formed through the center of top wall 50 and sized to receive at least a portion of trunk support 32, as will be further described below. Top wall 50 is formed of any suitable shape, such as, a circular, triangular, rectangular, polygonal, or hexagonal shape.

Sidewall 52 extends around a substantial entirety of an outer perimeter of top wall 50 in a manner defining an outside surface 60 an opposing inside surface 62. In one example, such as where top wall 50 is circular or ovular, sidewall 52 is at least partially curvilinear; while in other examples, top wall 50 is formed of adjacent linear sections thereof, such as where top wall is square, triangular, etc. Housing 40, more specifically, top wall 50 and sidewall 52, defines an open cavity 66 therein, adjacent bottom surface (not shown) of top wall 50 and inside surface 62 of sidewall 52. In one example, an aperture 64 is formed in one of sidewall 52 and bottom cover 44 to allow a portion of light sources assembly to transition from within open cavity 66 to outside open cavity 66, as will be further described below.

In one embodiment, a corner groove 68 is formed at the intersection of top wall 50 and sidewall 52 around a substantial entirety of a perimeter of top wall 50. Corner groove 68 defines a groove top wall 70 and a groove sidewall 72. Groove top wall 70 is downwardly offset and coaxially positioned around top wall 50, in one example, such that groove top wall 70 is substantially parallel to top wall 50, a distance substantially equal to a height of corner groove 68. Groove sidewall 72 is radially inset from sidewall 52 a distance equal to a cross-sectional width of corner groove 68 and extends radially inwardly from top wall 50 to groove top wall 70, for example, in a manner substantially parallel to top wall 50.

In one example, bottom wall 54 extends inwardly from an outer perimeter of sidewall 52. Bottom wall 54 is substantially parallel to top wall 50, in one embodiment, and defines a top surface 74 an a bottom surface 76 opposite top surface 74, with top surface 74 facing open cavity 66. In one example, bottom wall 54 is a partial wall only, extending partially across the open side of open cavity 66.

Weight 42 includes one or more weight plates 80 and 82 or other suitably heavy structures sized to fit substantially entirely within open cavity 66. Weight 42 is of a sufficient heaviness to facilitate maintaining light fixture 10 on a support surface (not shown) and to counteract any likelihood that light fixture 10 may tip about platform 30. In one example, weight plates 80 and 82 are stacked one on top of the other and each include an aperture 84, for example, through a center portion thereof. When weights 42 are placed in open cavity 66, aperture(s) 84 align with aperture 58 of housing 40 for receiving portions of light source assembly 34, as will be further described below.

Bottom cover 44 is formed in a plate form in the general overall shape of bottom wall 54, and in one example, to be slightly smaller than or substantially identical in overall size as bottom wall 54. Bottom cover 44 defines a top surface 90 and a bottom surface 92 opposite top surface 90. Bottom surface 92 is configured to contact a support surface (not shown) such as table top or floor, and in one example, includes friction enhancing features or qualities to decrease the slidability of light fixture 10 over the support surface, as will be understood by those of skill in the art reading the present application. Top surface 90 of bottom cover 44 is coupled with bottom wall 54 of housing 40, which, in one example, closes open cavity 66, such that housing 40 and bottom cover 44 collectively encompass weight 42.

Figure 5:
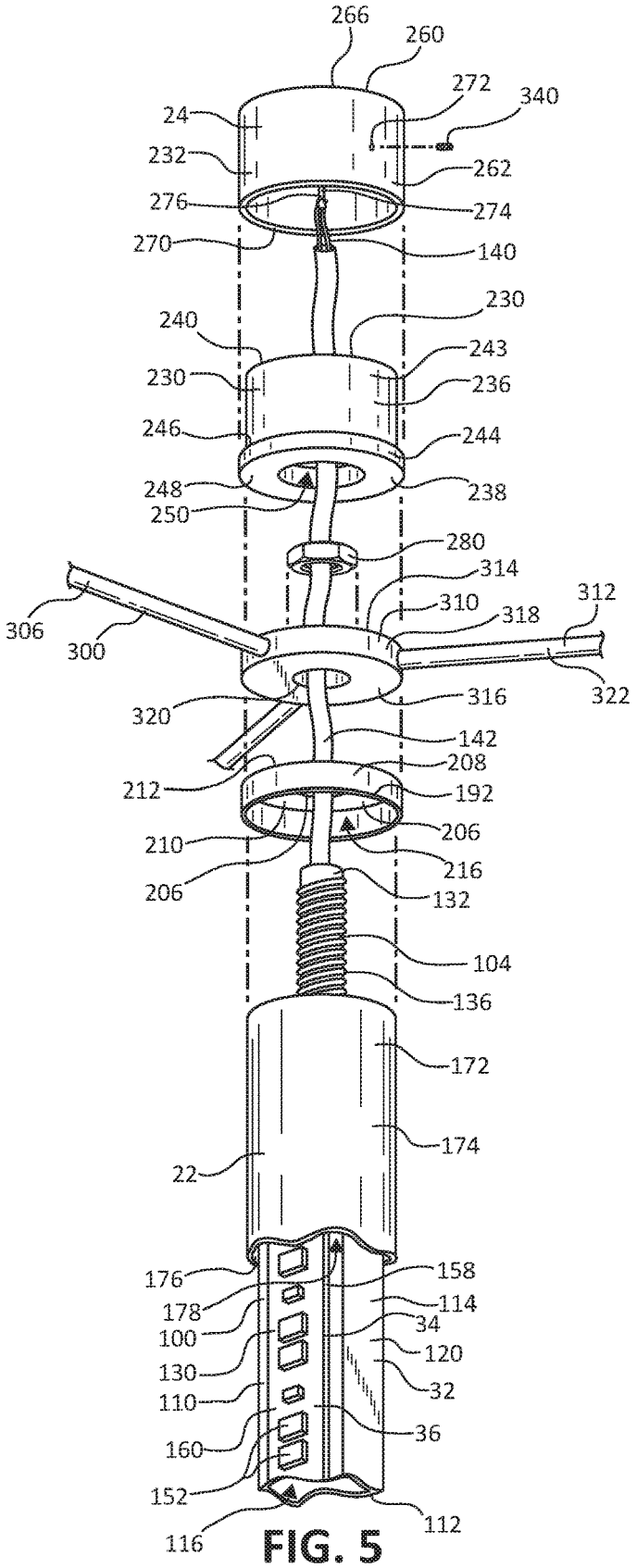
FIG. 5 is a top portion detail view of an exploded, front perspective view illustration of the light fixture of FIG. 1, according to one embodiment of the present invention.

Trunk support 32 couples with and extends upwardly from platform 30. Referring to FIGS. 3-5, in one embodiment, trunk support 32 includes a trunk body 100, a bottom coupling extension 102, and a top coupling extension 104. Trunk body 100 is hollow and elongated, having a much larger length than width or depth, such that trunk body 100 defines and extends between a bottom end 106 and a top end 108, opposite bottom end 106. In one example, trunk body 100 has a rectangular cross-sectional shape and defines a front panel 110, a rear panel 112 opposite front panel 110, and opposing side panels 114 opposite one another and extending between front panel 110 and rear panel 112. Interior surfaces 118 of each of front panel 110, rear panel 112, and opposing panels 114 are each adjacent an elongated cavity 116 defined by and extending throughout a length of trunk body 100. In one example, each of front panel 110, rear panel 112, and opposing side panels 114 are substantially planar.

Front panel 110, rear panel 112, and opposing side panels 114 each also define an exterior surface 120 opposite a corresponding interior surface 118 of the corresponding front panel 110, rear panel 112, and opposing side panels 114. In one example, one or more apertures 122 are formed through one or more of front panel 110, rear panel 112, and opposing side panels 114. Each of apertures 122 provides communication with elongated cavity 116 and allowing passage of wiring, etc. therethrough.

Bottom coupling extension 102 is partially maintained within elongated cavity 116 and extends out of bottom end 106 of trunk body 100 to interface with platform 30. In one example, bottom coupling extension 102 is elongated defining a top or first end 124 and a bottom or second end 126, which is opposite first end 124. First end 124 of bottom coupling extension 102 is maintained within elongated cavity 116 of trunk body 100 and statically secured thereto via any suitable method, such as welding. Second end 126 of bottom coupling extension 102 extends beyond bottom end 106 of trunk body 100. Bottom coupling extension 102 is statically coupled to trunk body 100 near bottom end 106 of trunk body 100. As such, trunk body 100 and bottom coupling extension 102 are coaxially positioned with respect to each other, in one embodiment. Bottom coupling extension 102 includes a cavity 130 extending throughout a length of bottom coupling extension 102 and providing access to elongated cavity 116 of trunk body 100. In one example, second end 126 of bottom coupling extension 102 includes threads 128 to facilitate coupling trunk support 32 with platform 30, as will be further described below.

Top coupling extension 104 is partially maintained within elongated cavity 116 and extends out of top end 108 of trunk body 100 to interface with finial 24. In one example, top coupling extension 104 is elongated defining a top or first end 132 and a bottom or second end 134, which is opposite first end 132. First end 132 of top coupling extension 104 is maintained within elongated cavity 116 of trunk body 100 and is secured to trunk body 100 in any suitable method, such as via welding. Second end 134 of top coupling extension extends beyond first end 132 of trunk body 100. Top coupling extension 104 is statically coupled to trunk body 100 near top end 108 of trunk body 100, such that trunk body 100 and top coupling extension 104 are coaxially positioned with respect to each other, in one embodiment. Top coupling extension 104 includes a cavity 138 extending throughout a length of top coupling extension 104 and providing access to elongated cavity 116 of trunk body 100. In one example, second end 134 of top coupling extension 104 includes threads 136 to facilitate coupling trunk support 32 with shade 14 and/or finials 24, as will be further described below.

Light source assembly 34 is coupled to and fully supported by trunk support 32, such that light emitted from light strips 36 is directed away from trunk support 32. In one example, each of light strips 36 includes a printed circuit board (PCB) 150 base with light emitting diodes (LEDs) 152 or other light sources mounted thereon. While various types of LEDs 152 may be used, in one example, LEDs 152 are generally configured to emit while light but allow for the selection of the warm of such white light by a controller. More specifically, as illustrated in the FIGS. 3-5, PCB 150 is substantially planar and cut in a linear form and defines a first or bottom end 154 and a second or top end 156 opposite bottom end 154. PCB 150 additionally defines a backing surface 158 and a mounting surface 160 opposite backing surface 158. LEDs 152 are linearly spaced along and secured to mounting surface 160, where PCB 150 includes the circuitry for electrically linking LEDs 152 to each other and/or a power source, e.g., via electrical plug 146.

Figure 6:
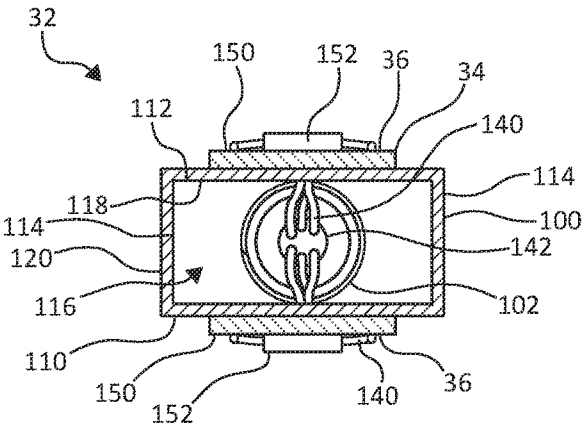
FIG. 6 is cross-sectional view illustration of a trunk support of the lamp taken along the line X-X in FIG. 3, according to one embodiment of the present invention.

Additionally referring to the cross-sectional view of FIG. 6, in one example, a different one of light strips 36 is secured to exterior surfaces 120 of at least one, and in one example, of at least two, of the panels 110, 112, and 114 of trunk body 100. In the illustrated embodiment, one of light strips 36 is secured to front panel 110 of trunk body 100, and another of light strips 36 is secured to rear panel 112 of trunk body 100. In this manner, light emitted from each light strip 36 is directed away from trunk body 100 and from each other. Otherwise stated, each light strip 36 emits light in a direction generally opposite to the other, for example, to give a larger arc, of light emission to light fixture 10.

Wiring 140 extends from LEDs 152 directly and/or the circuitry of PCB 150 for coupling with a power source and/or a control feature. In one example, wiring 140 of light source assembly 34 extends from each light strip 36 extends into elongated cavity 116 of trunk body 100, such as via apertures 122 in both front panel 110 and rear panel 112 of trunk body 100, and exits elongated cavity 116 through cavities 130 and 138 of bottom and top coupling extensions 102 and 104. In one embodiment, a cord cover 142 is placed around wires 140 grouped in a bundle once wires 140 are in elongated cavity 116. In one embodiment, cord cover 142 may be shortened and/or eliminated. In one example, a portion of wiring 140 with or without cord cover 142 extends from bottom ends 154 of light strips 36, into trunk body 100 though apertures 122, through bottom coupling extension 102, into cavity 66 of housing 40, and out sidewall 52 via aperture 64 ultimately terminating at an electrical plug 146, in one example, for interfacing with a power source (not shown). Another portion of wiring 140 with or without cord cover 142 extends from top ends 156 of light strips 36 through apertures 122, into trunk body 100 through apertures 122, and through top coupling extension 104 to extends out the top of trunk support 32 as shown in the example of FIG. 3.

Figure 7:
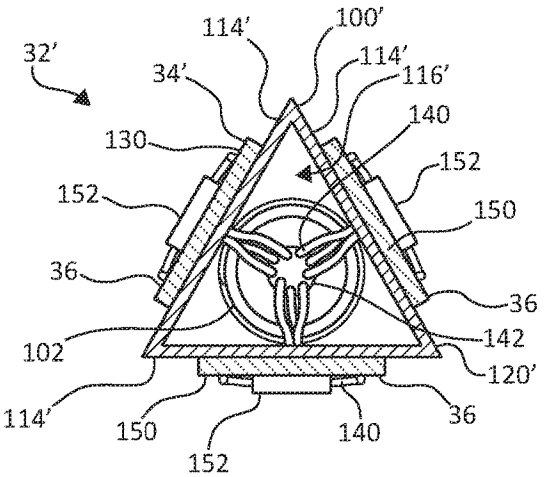
FIG. 7 is alternate cross-sectional view illustration to the illustration of FIG. 6 of a trunk support of a lamp, according to one embodiment of the present invention.

Other configurations of trunk body 100 and light source assembly 34 are also contemplated and will be apparent to those of skill in the art upon reading the present application. For example, FIG. 7 illustrates a cross-sectional view of a different trunk body 100' and light source assembly 34'. Trunk body 100' and light source assembly 34' are substantially identical to trunk body 100 and light source assembly (see, e.g., FIG. 6) other than differences described herein, in one embodiment. Trunk body 100' includes three side panels 114', rather than front panel 110, rear panel 112, and opposing side panels 114 of trunk body 100, forming trunk body 100' with a triangular cross-sectional shape. A different light strip 36 is coupled to exterior surfaces 120' of each the three side panels 114' and wires 140' thereof are thread into elongated cavity 116' in a similar manner as described above for wires 140 of FIG. 6.

Referring to FIG. 1, diffusing tube 22 is elongated and configured to diffuse the point light emitted from LEDs 152 to provide a more continuous emission of light from lamp 12 largely visually eliminating or at least decreasing the appearance of point sources of the light from the LEDs 152. Diffusing tube 22 is cylindrical in the illustrated embodiments, while in other embodiments, is another suitable hollow, elongated form. Diffusing tube 22 defines a first or bottom end 170, a second or top end 172 positioned opposite bottom end 170, an exterior surface 174, and an interior surface 176. Exterior surface 174 faces away from a center of diffusing tube 22; while interior surface 176 faces the center of diffusing tube 22 and is adjacent elongated cavity 178 running along an entire length of diffusing tube 22.

Diffusing tube 22 is coupled to a remainder of light lamp 12 via a bottom cap 190 and a top cap 192, which are substantially identical to each other, in one embodiment. In one example, bottom cap 190 includes a bottom panel 194 and a sidewall 196 extending around a perimeter of bottom panel 194 and upwardly therefrom. Bottom panel 194 has a similar overall shape as the cross-sectional shape of diffusing tube 22, for example, a circular or other suitable shape. In one example, bottom panel 194 has an overall size just greater than an overall size of the cross-section shape of diffusing tube 22. Bottom panel 194 is substantially planar and defines a bottom surface 198 and a top surface 200 opposite bottom surface 198. A hole 202 is formed through a center of bottom panel 194 and provides access to a cavity 204 formed by bottom cap 190 between top surface 200 of bottom panel 194 and sidewall 196.

In one example, top cap 192 includes a top panel 206 and a sidewall 208 extending around a perimeter of bottom panel 194 and upwardly therefrom. Top panel 206 has a similar overall shape as the cross-sectional shape of diffusing tube 22, for example, a circular or other suitable shape. In one example, top panel 206 has an overall size just greater than an overall size of the cross-sectional shape of diffusing tube 22. Top panel 206 is substantially planar and defines a bottom surface 210 and a top surface 212 opposite bottom surface 210. A hole 214 is formed through a center of top panel 206 and provides access to a cavity 216 formed by top cap 192 between bottom surface 210 of top panel 206 and sidewall 208. Bottom and top caps 190 and 192 are configured to horizontally register diffusing tube 22 with trunk body 100, such that diffusing tube 22 and trunk body 100 are coaxially maintained relative to each other, as will be further described below.

Base fixture 20 and diffusing tube 22 are assembled as generally illustrated in FIGS. 3 and 4. More specifically, in one example, as illustrated in FIG. 4, during assembly, bottom coupling extension 102 of trunk support 32 is inserted through hole 202 of bottom cap 190. Bottom cap 190 is positioned such that top surface 200 of its bottom panel 194 faces and is positioned adjacent bottom end 106 of trunk body 100. In this position, an open side of cavity 204 of bottom cap 190 faces upwardly toward trunk body 100. Bottom cap 190 is secured to trunk support 32 via a nut or other fastener 220, positioned on an opposite side of bottom panel 194 as compared to trunk body 100, for example, via rotating fastener 220 about threads 128 of bottom coupling extension 102 until bottom panel 194 is secured adjacent to trunk body 100.

Housing 40 of platform 30 is coupled to bottom coupling extension 102 below bottom cap 190. However, in one example, a nonconductive disk 180 is positioned between bottom cap 190 and platform 30. Nonconductive disk 180 includes a top surface 182, a bottom surface 184 opposite top surface 182, an outer perimeter edge 186 extending between top surface 182 and bottom surface 184. An aperture 188 is formed through the center of nonconductive disk 180. Aperture 188 is sized larger than an overall diameter of fastener 220 and smaller than an overall diameter of bottom cap 190, in one embodiment. Nonconductive disk 180 and has a thickness, measured between top surface 182 and bottom surface 184, greater than a thickness of fastener 220. In this manner, nonconductive disk 180 is positioned around bottom coupling extension 102 and fastener 220, placing top surface 182 adjacent bottom surface 198 of bottom cap 190. When so positioned, fastener 220 is inset from bottom surface 184 of nonconductive disk 180.

Housing 40 is placed around bottom coupling extension 102 next, more specifically, is placed such that top surface 56 of top wall 50 of housing 40 is positioned adjacent bottom surface 184 of nonconductive disk 180 and will subsequently be secured in this position, as will be further described below. In one embodiment, due to the thickness of nonconductive disk 180, fastener 220 does not contact housing 40 creating a discontinuity of metal such that any capacitance or other charges to platform 30 are not imparted to the remainder of lamp 12. In one embodiment, nonconductive disk 180 provides a cushion between platform 30 and trunk support 32 and may or may not limit electrical continuity between other members of lamp 12.

Weight 42 is placed around bottom coupling extension 102 adjacent bottom surface (not shown) of top wall 50 of housing 40. For example, aperture(s) 84 of one or more of weight plates 80 and 82 receives bottom coupling extension 102, and weight 42 is positioned tight against top wall 50 of housing 40. In this manner, weight 42 is fully positioned within cavity 66 of housing 40. A nut or other suitable fastener 218 is secured below weight 42 and around bottom coupling extension 102 to maintain two or more of nonconductive disk 180, top wall 50 of housing 40, and weight 42 in close contact with and secured in place relative to one another. For example, fastener 218 is coupled with bottom coupling extension 102 via threaded interaction therewith.

As described above, at least a portion of wiring 140 extends out of trunk body 100 via cavity 130 in bottom coupling extension 102. Since bottom cap 190, fastener 220, nonconductive disk 180, top wall 50, weights 42, and fastener 218 are all secured along the length of bottom coupling extension 102, it follows that wiring 140 also extends through bottom cap 190, fastener 220, nonconductive disk 180, top wall 50, weights 42, and fastener 218. Wiring 140 exiting out of second end 126 of bottom coupling extension 102 does so and enters into cavity 66 of housing 40. Wiring 140, in turn, extends out of cavity 66 via aperture 64 in sidewall 52 of housing 40, in one example, to eventually termination in electrical plug 146. In one example, a portion of wiring 140 and electrical plug 146 are eliminated and wiring 140 instead interacts with a power source maintained within cavity 66 of housing 40, such as a battery power source, etc.

Bottom cover 44 is placed over the bottom opening to cavity 66 to create a more continuous surface for interacting with an external support surface of a table, floor, etc. and/or to enhance the aesthetics of lamp 12. Top surface 90 of bottom cover 44, more specifically, in one example, is positioned adjacent and secured to bottom surface 76 of bottom wall 54 of housing 40 using any suitable fastening agent, such as adhesive, welding, rivets, screws, etc. In this manner bottom surface 92 of bottom cover 44 interfaces with the external support surface during use. According to one example, at this point of assembly, base fixture 20 resembles that shown on the left side of FIG. 3.

Diffusing tube 22 is slid over trunk body 100 nesting bottom end 170 in cavity 204 of bottom cap 190 such that sidewall 196 of bottom cap 190 surrounds bottom end 170 of diffusing tube 22. Diffusing tube 22 has a sufficient length to cover trunk body 100 such that top coupling extension 104 extends above top end 172 of diffusing tube 22. Referring to FIG. 5, top cap 192 is slid over top coupling extension 104 via hole 214 in top cap 192. Once top cap 192 is positioned, cavity 216 of top cap 192 receives top end 172 of diffusing tube 22. In one example, sidewall 208 of top cap 190 surrounds top end 172 of diffusing tube 22. In one embodiment, a fastener (not shown), is placed over top coupling extension 104 to secure top cap 192 in place. In the illustrated embodiment, prior to any fastener placement, lamp 12 receives shade 14 via top coupling extension 104.

Referring to FIGS. 1 and 2, shade 14 includes a frame 300 and trimming 302. Frame 300 serves as the skeletal support of shade 14 while trimming 302 serves as the body of shade 14 supported by frame 300. In one example, frame 300 includes a top frame ring 304, a spider element 306, and a bottom frame ring 308 each formed of any suitable, substantially rigid material, such as metal. As used herein, "ring" refers to closed shape or encompassing assembly whether such assembly is circular (as illustrated in the drawings), ovular, rectangular, or otherwise suitably shaped. In one example, top frame ring 304 defines a top perimeter of shade 14, and bottom frame ring 308 defines a bottom perimeter of shade 14. Each of top frame ring 304 and bottom frame ring 308 are substantially closed loops in any desired shape to achieve the desired aesthetic appearance of shade 14. In one example, top frame ring 304 and bottom frame ring 308 are positioned in parallel planes relative to one another and are spaced apart from one another a distance substantially equal to an overall height of shade 16. In one example, bottom frame ring 308 is sized and shaped substantially identically to corner groove 68 in platform 30, as will be further described below.

Spider element 306 facilitates coupling shade 14 to lamp 12, according to one embodiment of the invention. In one example, spider element 306 is coupled to top frame ring 304 and generally extends inward from top frame ring to interface with lamp 12. Spider element 306 includes a coupling ring 310 and arms 312. Coupling ring 310 is concentrically placed relative to top frame ring 304 in a manner that is one of coplanar and non-coplanar with top frame ring 304. In the illustrated embodiment, coupling ring 310 is positioned at a lower height than top frame ring 304, that is, is positioned closer to bottom frame ring 308 than top frame ring 304 is positioned relative to bottom frame ring 308. Coupling ring 310 is formed of a plate with a substantially circular shape to define a top surface 314, a bottom surface 316 opposite top surface 314, and a perimeter edge 318 extending between top surface 314 and bottom surface 316, in one example. Coupling ring 310 defines an aperture 320 through a center thereof. Aperture 320 is sized to receive top coupling extension 104, in one embodiment.

Arms 312 of spider element 306 are circumferentially spaced around and radially extend outwardly and upwardly from coupling ring 310 to top frame ring 304. Each arm 312 is, more specifically, secured to or near to perimeter edge 318 of coupling ring, in one example, via welding or other suitable fastening means. In one embodiment, where coupling ring 310 is non-coplanar positioned relative to top frame ring 304, each of arms 312 includes first segment 322 and a second segment 324. First segment 322 radially extends from coupling ring 310 generally in a common plane with coupling ring 310. Second segment 324 extends from first segment 322 opposite coupling ring 310 with both a radial outward and upwardly orientation and is coupled to top frame ring 304 opposite first segment. Arms 312 are each of a similar size and shape to position coupling ring 310 in a coaxial position relative to top frame ring 304 and to maintain coupling ring 310 in a specified vertical position relative to top frame ring 304.

Trimming 302 is coupled to each of and extends between top frame ring 304 and bottom frame ring 308. In one example, trimming 302 is at least partially wrapped around each of top frame ring 304 and bottom fame ring 308. Accordingly, a height of trimming 302 generally corresponds to an overall height of shade 14. Trimming 302, in one example, is provided in the form of fabric, paper, or other similar material(s) providing light diffusing or blocking characteristics to shade 14. In one embodiment, trimming 302 is formed of dual or other multiple layers including an outer layer 330 and an inner layer 332. Outer layer 330 provides the overall aesthetic appeal to shade 14 and is the portion of shade 14 generally visible upon assembly of light fixture 10. In one example, outer layer 330 is formed of paper, fabric, or other suitable material. Inner layer 332, in one example, is formed from paper, plastic, or other suitable material providing additional structural rigidity and stability to shade 14. Outer layer 330 and inner layer 332 are selected to collectively provide desired diffusive properties to, in addition to diffusing tube 22, additionally obscure the point source of the emitted light providing an appealing light emission from light fixture 10.

During assembly of light fixture 10, shade 14 is coupled with trunk body 100 as shown in FIG. 5. More specifically, aperture 320 is aligned with top coupling extension 104, and shade 14 is slid onto top coupling extension 104 using aperture 320. In one example, bottom surface 316 faces and/or is positioned adjacent top surface 212 of top cap 192. Once so positioned, bottom frame ring 308 is positioned to nest in corner groove 68 of platform, for example, as illustrated in FIG. 1. Bottom frame ring 308 and corner groove 68 help maintain the horizontal positioning of a bottom portion of shade 14 while providing a clean visual aesthetic in combination with platform 30. In one embodiment, shade 14 is secured to trunk body 100 with a nut or other suitable fastener 280 thread onto top coupling extension 104 to be positioned just above, and in one example, in contact with, top surface 314 of coupling ring 310. Light fixture 10 is then ready to receive finial 24.

Figure 8:
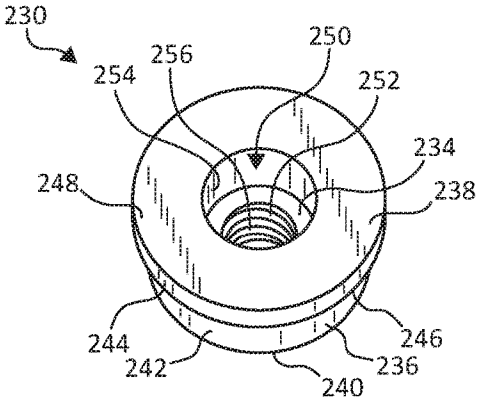
FIG. 8 is a bottom perspective view of an insulating collar of a finial of the light fixture of FIG. 1, according to one embodiment of the present invention.

Finial 24 of lamp 12, in one example, includes an insulating collar 230 and a finial cap 232 as illustrated in FIGS. 1 and 5. Insulating collar 230 fits over top coupling extension 104 first, and finial cap 232 extends over a substantial portion of insulating cover 230. Referring to FIG. 5 and the detail view of FIG. 8, in one embodiment, insulating collar 230 includes a top panel 234, a sidewall 236, and a bottom flange 238. Top panel 234 is substantially planar, has a substantially circular shape, and defines an exterior or top surface 240. Sidewall 236 extends from a perimeter of top panel 234 away from top surface 240 and defining an exterior surface 243. Bottom flange 238 extends radially outwardly from about a perimeter of sidewall 236 opposite top panel 234. Bottom flange 238 defines a perimeter edge 244 opposite sidewall 236, a top surface 246, and a bottom surface 248 opposite top surface 246.

Insulating collar 230 additionally defines a cavity 250 extending through the axial center of insulating collar 230. In one example, cavity 250 includes a first or top cavity portion 252 and a second or bottom cavity portion 254. Top cavity portion 252 is open through a center of top panel 234 and extends toward bottom surface 248. Top cavity portion 252 is sized and shaped to receive top coupling extension 104, and in one example, includes threads 256. Bottom cavity portion 254 is in communication with top cavity portion 252 and extends from bottom surface 248 toward exterior surface 240. Bottom cavity portion 254 has a larger width than top cavity portion 252.

Figure 9:
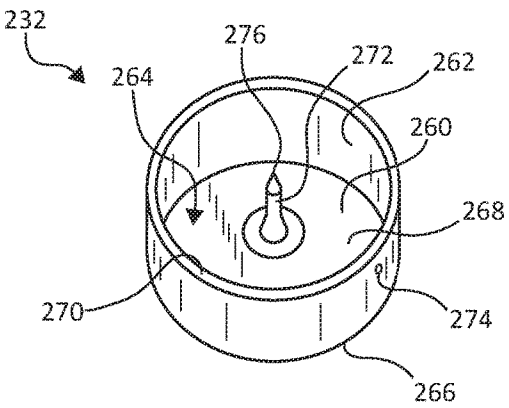
FIG. 9 is a bottom perspective view of a cap of a finial of the light fixture of FIG. 1, according to one embodiment of the present invention.

Referring FIG. 5 and FIG. 9, finial cap 232 is generally cylindrical or otherwise suitably shaped and hollow. In one embodiment, finial cap 232 includes a top panel 260 and a sidewall 262 extending about a perimeter of top panel 260 and downwardly therefrom to form a cavity 264 therein to a bottom sidewall edge 270. Top panel 260 defines a top surface 266 facing in a direction opposite cavity 264 and a bottom surface 268 adjacent cavity 264. Finial cap 232 includes a depending pin 274 extending downwardly from a center of bottom surface 268 to a bottom end 276 thereof. In one example, finial cap 232 including depending pin 274 is formed of metal or other conductive material. In one embodiment, an aperture 272 is formed through sidewall 262, and in one instance, is threaded.

During assembly of light fixture 10, finial 24 is placed on top coupling extension 104 of trunk support 32 over coupling ring 310 of shade 14, as best illustrated in FIG. 5. More specifically, in one example, insulating collar 230 is first placed onto and threadably secured to top coupling extension 104 of trunk support 32. Bottom surface 248 of bottom flange 238 of insulating collar 230 faces and, in one example, contacts coupling ring 310. When positioned, fastener 280 is positioned within bottom cavity portion 254 of insulating collar 230 to hide fastener 280 from view. In one example, insulating collar 230 extends to or beyond a top of top coupling extension 104.

Finial cap 232 is placed over insulating collar 230. However, in one example, prior to placing finial cap 232 over insulating collar 230, wiring 140 from light source assembly 34 is coupled with finial cap 232. In one embodiment, wiring 140 from light source assembly 34 is soldered or otherwise electrically and mechanically connected to bottom end 276. Since finial cap 232 is formed of metal or other conductive material, coupling of wiring 140 to finial cap provides electrical continuity between light source assembly 34 and finial 24. The electrical continuity allows finial 24 to serve as a touch switch for controlling light source assembly 34. In one example, finial 24 is a touch switch via capacitance. More particularly, the capacitance of light fixture 10 when standing alone has a first capacitance. When a user touches finial 24, which is in electrical continuity with light source assembly 34, the capacitance of light fixture 10 is altered, e.g., increased. The electrical components of light source assembly 34 sense the additional capacitance and are programmed to alter light emitted from light source assembly 34 accordingly, e.g., to dim light, change light color, to turn on, or to turn of LEDs 152.

Finial cap 232 is placed over insulating collar 230 or at least sidewalls 236 thereof to largely hide insulating collar 230 from view. When so positioned, depending pin 274 of finial cap 232 extends into cavity 250 insulating collar 230 without contacting sidewall 236. Finial cap 232 is secured in position about insulating collar 230 in any suitable manner, for example, using a set screw 340 thread through aperture 272 and burrowing into sidewall 236 of insulating collar 230. By surrounding depending pin 274 and spacing finial 24 from any other portion of light fixture 10 other than insulating collar 230 and wiring 140, insulating collar 230 prevents or at least decreases capacitance interference from surround surfaces, etc. that may cause finial to less reliably function as a touch control for lamp 12.

Figure 10:
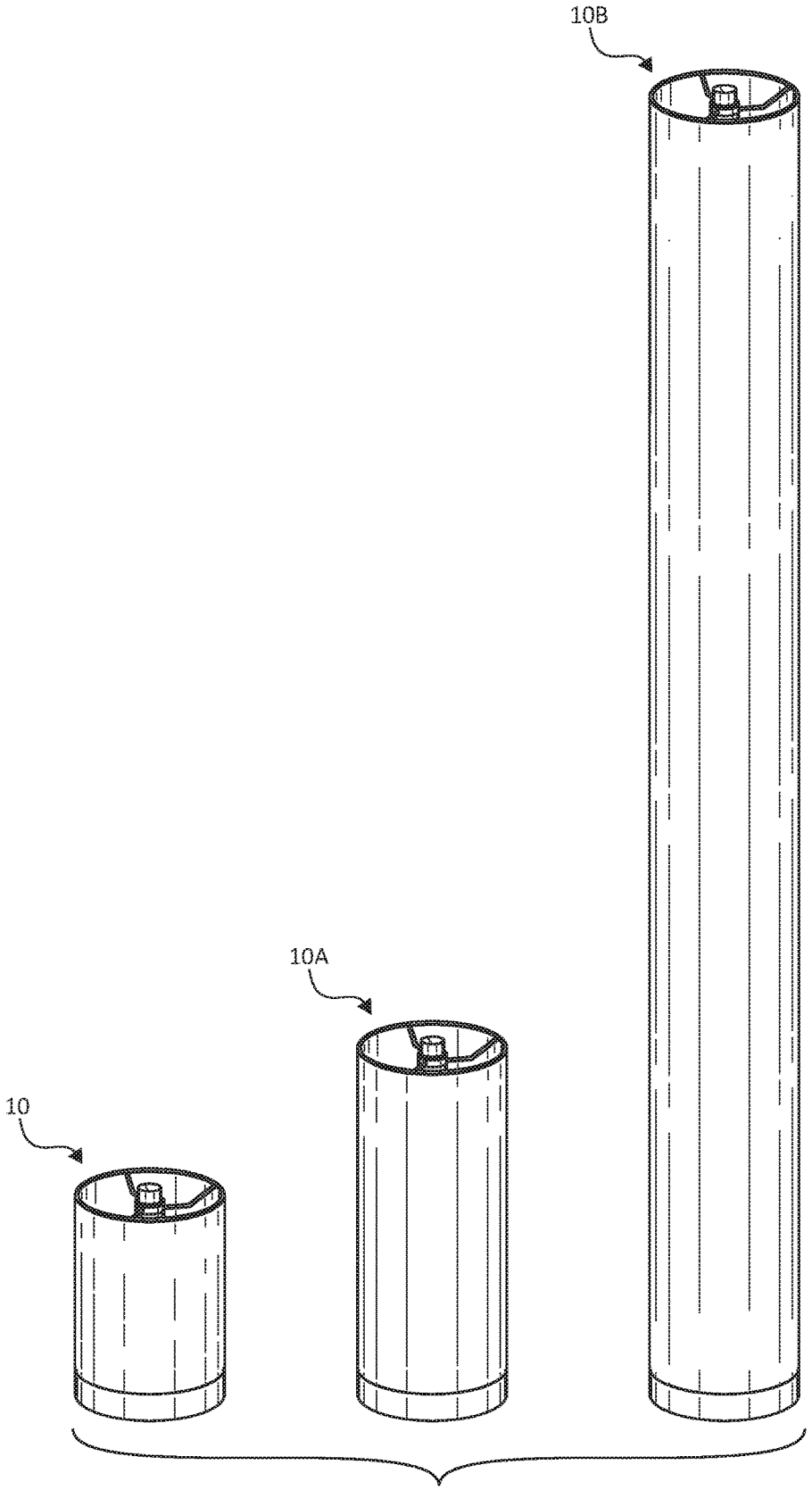
FIG. 10 is a front perspective view illustration collection of light fixtures including the light fixture of FIG. 1, according to one embodiment of the present invention.

While light fixture 10 is shown of a particular size, other sized light fixtures are also contemplated. For example, FIG. 10 shows light fixture 10 along with light fixtures 10A and 10B, which are taller than light fixture 10 but are otherwise similar to light fixture 10 as shown in FIG. 1. It should be understood, that light fixtures 10A and 10B are generally formed by increasing the length of trunk support 32, increasing the number of light sources 152 and/or light strips 36, and increasing the length of shade 10. Other variations are also contemplated and will be apparent to those of skill in the art upon reading this application.

Embodiments of the present invention provide a light fixture having increased life span and efficiency due to LED incorporation while outputting an a collective overall light output similar to conventional lamps by diffusing the point light output. The light fixture additionally makes use of a single trunk for both supporting the light strips including the LEDs and for supporting a tubular shade. In one embodiment, light fixture additionally includes a dual function finial that not only serves as a decorative topper to the light fixture as in the prior art, but also is maintained in electrical continuity with light source assembly such that the finial itself provides a touch control for the light fixture.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A light fixture comprising:

a platform;

a trunk support coupled to and extending upwardly from the platform, wherein the trunk support defines an elongated cavity therein, exterior surfaces facing away from the elongated cavity, and an end opposite the platform, and the end defines an opening to the elongated cavity;

a light source assembly including light sources and wiring in electrical communication with the light sources, wherein the light sources are coupled to one or more of the exterior surfaces of the trunk support, and a portion of the wiring extends from the light sources, into the elongated cavity, and out the opening in the end of the trunk support; and a finial capping the end of the trunk support, wherein the finial is at least partially formed of a conductive material and is coupled with the portion of the wiring extending out the opening in the end of trunk support to maintain electrical continuity with the light source assembly and allowing the finial to function as a touch control for the light source assembly.

2. The light fixture of claim 1, wherein:

the light source assembly includes a printed circuit board supporting the light sources, and the printed circuit board is coupled directly to the one or more of the exterior surfaces of the trunk support.

3. The light fixture of claim 2, wherein the light sources are each a light emitting diode (LED).

4. The light fixture of claim 2, wherein:

the light sources are coupled to at least two surfaces of the trunk support, and the at least two surfaces face in different directions.

5. The light fixture of claim 1, further comprising a shade including trimming and a frame, wherein:

the frame includes a coupling ring, the trunk support includes a top coupling extension, the finial is coupled to the top coupling extension opposite the light sources, and the coupling ring fits around the top coupling extension positioned between the light sources and the finial.

6. The light fixture of claim 5, further comprising a diffusing tube extending around the trunk support to cover the light sources, the coupling ring is positioned above the diffusing tube, and the trimming of the shade surrounds the diffusing tube.

7. The light fixture of claim 6, further comprising a cap extending over a top end of the diffusing tube, wherein the wiring extends through the cap, and the coupling ring sits adjacent the cap.

8. The light fixture of claim 1, wherein:

the trunk support includes a top coupling extension, the finial comprises a finial cap formed of the conductive material secured to the top coupling extension, and the finial cap is electrically coupled with the wiring.

9. The light fixture of claim 8, wherein:

the finial cap includes a top panel and a depending pin extending downwardly from the top panel.

10. The light fixture of claim 9, further comprising a collar; wherein:

the collar extends around and above the top coupling extension such that the collar is positioned above the light sources, the collar is formed of a nonconductive material, the finial cap covers the collar, and both the depending pin and the wiring extend into the collar.

11. The light fixture of claim 10, wherein the top coupling extension is threaded, and the collar is threadably coupled to the top coupling extension.

12. The light fixture of claim 1, further comprising a shade including a trimming and a frame, wherein:

the frame includes a top frame ring, a bottom frame ring opposite the top frame ring, and a spider element coupled to the top frame ring, the spider element is coupled to the end of the trunk support opposite the platform;

the platform includes a corner groove spaced above a bottom of the platform and extending substantially entirely around the platform, and the bottom frame ring nests within the corner groove.

13. The light fixture of claim 1, wherein the trunk support is substantially linear.

14. The light fixture of claim 1, wherein the trunk support has a substantially rectangular cross-sectional shape.

15. A method of assembling a light fixture, the method comprising:

positioning a trunk support to extend upwardly from a platform, wherein the trunk support defines an elongated cavity therein, exterior surfaces facing away from the elongated cavity, and an end opposite the platform, and the end defines an opening to the elongated cavity;

coupling light sources of a light source assembly to one or more of the exterior surfaces of the trunk support, wherein the light source assembly includes the light sources and wiring in electrical communication with the light sources, and coupling the light sources to the one or more exterior surfaces of the trunk support includes positioning a portion of the wiring coupled to the light sources to extend from the light sources, into the elongated cavity, and out the opening in the end of the trunk support; and securing a finial to cover the end of the trunk support including coupling the portion of the wiring extending out the opening in the end of trunk support to the finial to maintain electrical continuity between the finial and the light source assembly and allowing the finial to function as a touch control for the light source assembly, wherein the finial is at least partially formed of a conductive material.

16. The method of claim 15, wherein:

the final includes a finial cap having a top panel and a depending pin extending downwardly from the top panel;

the top panel and the depending pin are each formed of the conductive material; and electrically and mechanically coupling the portion of the wiring extending out the opening in the end of trunk support to the finial includes securing the portion of the wiring to a pin end of the depending pin opposite the top panel of the finial cap.

17. The method of claim 16, wherein:

the trunk support includes a top coupling extension, the finial includes an insulating collar having a finial cavity therein; and securing the finial to cover the end of the trunk support includes:

threadably securing the insulating collar to the top coupling extension such that a portion of the top coupling extension is maintained in the finial cavity, and securing the finial cap over the insulating collar such that the depending pin extends into the cavity.

18. The method of claim 15, further comprising:

securing a shade to the trunk support, the shade including a trimming and a frame, and the frame including a coupling ring, the trunk support includes a top coupling extension;

wherein:

securing the finial to cover the end of the trunk support includes coupling the finial to the top coupling extension opposite the light sources, and securing the shade to the trunk support includes placing the coupling ring around the top coupling extension and in a position between the light sources and the finial.

19. The method of claim 18, further comprising:

sliding a diffusing tube around the trunk support to cover the light sources;

wherein placing the coupling ring around the top coupling extension includes positioning the coupling ring above the diffusing tube such that the trimming of the shade surrounds the diffusing tube.

20. The method of claim 18, wherein:

the frame includes a top frame ring, a bottom frame ring opposite the top frame ring, the coupling ring, and arms radially extending inwardly from the top frame ring to the coupling ring;

the platform includes a corner groove spaced above a bottom of the platform and extending substantially entirely around the platform, and securing the shade to the trunk support includes nesting the bottom frame ring within the corner groove of the platform.

* * * * *